US011598079B2

(12) United States Patent
Maruyama et al.

(10) Patent No.: US 11,598,079 B2
(45) Date of Patent: Mar. 7, 2023

(54) FLUSH TOILET

(71) Applicant: TOTO LTD., Kitakyushu (JP)

(72) Inventors: Takahiro Maruyama, Kitakyushu (JP); Wataru Ishimi, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 0 days.

(21) Appl. No.: 17/678,722

(22) Filed: Feb. 23, 2022

(65) Prior Publication Data

US 2022/0275627 A1 Sep. 1, 2022

(30) Foreign Application Priority Data

Feb. 26, 2021 (JP) ..... JP2021-030141

(51) Int. Cl.

*E03D 11/13* (2006.01)
*E03D 11/18* (2006.01)
*E03D 1/26* (2006.01)

(52) U.S. Cl.

CPC ..... *E03D 11/13* (2013.01); *E03D 1/26* (2013.01); *E03D 11/18* (2013.01)

(58) Field of Classification Search

CPC ..... E03D 11/13; E03D 1/26; E03D 11/18; E03D 2201/30; E03D 11/08; E03D 11/06; E03D 1/012; E03D 9/00; E03D 9/08

See application file for complete search history.

(56) References Cited

U.S. PATENT DOCUMENTS

2015/0159356 A1* 6/2015 Fukuya ..... E03D 5/01 4/329
2017/0350108 A1* 12/2017 Harashima ..... E03D 5/01

FOREIGN PATENT DOCUMENTS

| | | | |
|---|---|---|---|
| JP | 2002-294841 | A | 10/2002 |
| JP | 2010-270469 | A | 12/2010 |
| JP | 2011-256707 | A | 12/2011 |
| JP | 2017-89282 | A | 5/2017 |
| JP | 2017-95867 | A | 6/2017 |
| JP | 2020-180469 | A | 11/2020 |

* cited by examiner

*Primary Examiner* — Christine J Skubinna
(74) *Attorney, Agent, or Firm* — BakerHostetler

(57) ABSTRACT

A flush toilet includes a toilet main body and a control unit. The toilet main body includes a skirt, a rear storage configured to store at least a part of the control unit, and an opening to which a drain pipe is connected is formed penetrating, in a front-rear direction, a portion below a center in a left-right direction of a rear wall of the skirt. The rear storage forms a discharge socket storage on a front side of the opening in a region below a center of the rear storage in the left-right direction. And a side wall surface in the discharge socket storage protrudes more in a center direction of the opening than a side wall surface in the opening, to reduce an opening cross-sectional area of the discharge socket storage to be smaller than an opening cross-sectional area of the opening.

6 Claims, 14 Drawing Sheets

FLUSH TOILET

CROSS REFERENCE TO RELATED APPLICATION

This application claims benefit of priority to Japanese Patent Application No. 2021-030141, filed on Feb. 26, 2021, the entire content of which is incorporated herein by reference.

FIELD OF THE INVENTION

The present invention relates to a flush toilet, and more particularly, to a flush toilet which is flushed with flush water to discharge waste.

BACKGROUND OF THE INVENTION

Conventionally, as a flush toilet which is flushed with flush water to discharge waste, there is known, for example, as described in Patent Document 1 (Japanese Patent Laid-Open No. 2017-95867), a so-called "full skirt" or "total Hakama" flush toilet in which a skirt formed on an outer side than a side surface of each of a bowl of a toilet main body made of ceramics and a water discharge trap is formed all around the toilet main body. In this conventional "full skirt" or "total Hakama" flush toilet, a storage region that can store a control unit including a function of controlling the spout water to the bowl of the toilet main body is provided in a region more rearward than the bowl of the toilet main body.

Further, in each of conventional flush toilets described in Patent Document 1 (Japanese Patent Laid-Open No. 2017-95867), Patent Document 2 (Japanese Patent Laid-Open No. 2010-270469) and Patent Document 3 (Japanese Patent Laid-Open No. 2011-256707), a drain pipe extending from a rear wall back side of the flush toilet toward a toilet main body is connected to an outlet of a water discharge trap of the toilet main body via a discharge socket, behind and below the toilet main body. Consequently, a water discharge mode of the flush toilet is a water discharge mode of so-called "wall side discharge" in which water discharged from a bowl of the toilet main body to the water discharge trap is discharged from the outlet of the water discharge trap through the discharge socket to the drain pipe on the wall back side.

On the other hand, one of aims that have been requested to be achieved in recent years with design diversification of the flush toilet and improvement in design such as appearance of the flush toilet is to acquire a large storage region that stores a control unit in a region more rearward than a bowl of a toilet main body, while reducing (slimming) an external dimension of the whole toilet main body. Particularly, it is necessary to provide an opening to which a drain pipe extending from a wall side is connected, in a lower rear part of a toilet main body of a flush toilet with a wall side discharge mode, but around this opening, a space has to be acquired for providing a discharge socket that connects an outlet of a water discharge trap and the drain pipe extending from the wall side. However, as the opening of the drain pipe and the space around the discharge socket enlarge, a space to store a control unit in a region more rearward than the bowl of the toilet main body reduces. Therefore, there is a problem that, when a sufficient storage space for the control unit is to be acquired, the whole toilet main body enlarges. Also, an outer diameter of a conduit of the drain pipe is generally set to be larger than an outer diameter of a conduit of the discharge socket. Consequently, it is necessary to design a dimensional shape of the opening in a rear wall of a skirt, in accordance with a dimensional shape of the drain pipe rather than that of the discharge socket. Further, the discharge socket that connects the drain pipe and the outlet of the water discharge trap of the toilet main body made of ceramics is generally made of a flammable material such as a resin, and hence it is desirable not to expose the discharge socket to outside for fire protection. Furthermore, in each of the conventional flush toilets described in Patent Documents 1 to 3, as a measure of fire protection for the flammable discharge socket, a refractory member is provided around a joining portion between the opening in the toilet main body and the discharge socket, but there is also a problem that the space, around the discharge socket, required for the refractory member reduces the storage space of the control unit. Additionally, for example, there is a problem that as the drain pipe is connected to an inner side than the opening in the toilet main body (a region on a front side of the opening), the drain pipe occupies a larger internal space of the toilet main body in the region on the front side of the opening, and thus a storage region to store the control unit in the region more rearward than the bowl of the toilet main body is also reduced. Consequently, there is a problem that it is difficult to acquire a sufficient storage region that is available for storing the control unit in the region more rearward than the bowl of the toilet main body.

Accordingly, the present invention is aimed at solving problems of the conventional arts described above and is aimed at providing a flush toilet in which a large storage region that stores a control unit can be acquired in a region more rearward than a bowl of a toilet main body, while suppressing an external dimension of the whole toilet main body.

SUMMARY OF THE INVENTION

To solve the problems described above, an aspect of the present invention is a flush toilet comprising: a toilet main body made of ceramics, the toilet main body including a bowl configured to receive waste and a water discharge trap configured to discharge the waste in the bowl, the water discharge trap including an inlet connected to a lower portion of the bowl, a control unit provided more rearward than the bowl of the toilet main body, the control unit being configured to control discharge and stopping of flush water to the bowl, and a discharge socket configured to connect a drain pipe provided behind or below the toilet main body and an outlet of the water discharge trap, wherein the toilet main body further includes a skirt and a rear storage configured to store at least a part of the control unit, the skirt being formed on an outer side of side surfaces of the bowl and the water discharge trap, and the rear storage being provided below an upper end of the skirt and on an inner side than the skirt in a region more rearward than the bowl, the skirt includes a rear wall provided on a back surface of the toilet main body, and the rear wall includes an opening to which the drain pipe is connected, the opening being formed penetrating in a front-rear direction and below a center in a left-right direction of the rear wall of the skirt, the rear storage includes a discharge socket storage configured to store the discharge socket, the discharge socket storage being formed on a front side of the opening in a region below a center of the rear storage in the left-right direction, and a first side wall surface forming a side wall surface in the discharge socket storage protrudes more in a center direction of the opening than a second side wall surface forming a side wall surface in the opening in order to reduce an opening cross-sectional area of the discharge socket storage to be smaller than an opening cross-sectional area of the opening. According to the aspect of the present invention having this configuration, the rear storage of the toilet main body forms a storage region in the region more rearward than the bowl for allowing storage of at least a part of the control unit, and the first side wall surface that forms the side wall surface in the discharge socket storage below the center of the rear storage in the left-right direction protrudes more in the center direction of the opening than the second side wall surface that forms the side wall surface in the opening. Consequently, the opening cross-sectional area of the discharge socket storage can be reduced to be smaller than the opening cross-sectional area of the opening, and hence a wasted space that is unnecessary in connecting the drain pipe and the discharge socket can be reduced in a region from the opening of the toilet main body, to which the drain pipe is connected, to the discharge socket storage. Therefore, a large storage region that stores the control unit can be acquired in the region more rearward than the bowl of the toilet main body, while suppressing an external dimension of the whole toilet main body. Also, in the region from the opening of the toilet main body, to which the drain pipe is connected, to the discharge socket storage, the wasted space that is unnecessary in connecting the drain pipe and the discharge socket, and a flammable space around the discharge socket can be reduced, so that a fire protection performance for the discharge socket can be improved.

In the aspect of the present invention, preferably, the rear storage includes a supporting wall configured to support the control unit, the supporting wall divides the region more rearward than the bowl of the toilet main body in an up-down direction to form an upper region and a lower region, the upper region includes a storage region configured to store at least a part of the control unit, and the lower region includes an open region of each of the opening and the discharge socket storage, the supporting wall includes the first side wall surface, the second side wall surface, and a joining portion configured to join the first side wall surface and the second side wall surface to each other, and the joining portion is provided with a step configured to protrude the first side wall surface more in the center direction of the opening than the second side wall surface to reduce the opening cross-sectional area of the discharge socket storage to be smaller than the opening cross-sectional area of the opening. According to the aspect of the present invention having this configuration, the step provided in the joining portion that joins the first side wall surface and the second side wall surface to each other in the supporting wall allows the first side wall surface to protrude more in the center direction of the opening than the second side wall surface, so that the opening cross-sectional area of the discharge socket storage can be reduced to be smaller than the opening cross-sectional area of the opening. In this case, as compared with a case where the supporting wall is not provided with the step, the lower region of the rear storage can be reduced by the step, so that the upper region of the rear storage can be acquired more largely. Also, the step can be used for alignment of the drain pipe and the discharge socket, and the drain pipe is restricted by the step, so that misalignment of the drain pipe or the like can be suppressed. Therefore, while suppressing the external dimension of the whole toilet main body, the region more rearward than the bowl of the toilet main body is divided in the up-down direction by the supporting wall to form the upper region and the lower region, and the upper region can be effectively used as a part above the opening and the discharge socket storage.

In the aspect of the present invention, preferably, the skirt further includes a side wall forming a side surface of the skirt, at least a part of the side wall or the rear wall of the skirt forms a double wall including an outer wall and an inner wall, the outer wall forms an outer surface of the skirt, and the inner wall is provided inside the outer wall, at least a part of the double wall forms an internal space between the outer wall and the inner wall, and at least a part of the opening is formed by the double wall. According to the aspect of the present invention having this configuration, at least a part of the opening is formed by the double wall, so that strength of the opening can increase. Consequently, the number of members including a reinforcing member for reinforcing the opening can be decreased, so that a peripheral region of the opening can be effectively used as a part of the storage region that stores the control unit.

In the aspect of the present invention, preferably, the opening and the discharge socket storage have top surfaces that are formed to be substantially flush with each other. According to the aspect of the present invention having this configuration, since the opening and the discharge socket storage have the top surfaces that are formed to be substantially flush with each other, the number of members including a reinforcing member for acquiring strength of the opening or the discharge socket storage can be decreased. Therefore, a peripheral region around the opening and the discharge socket storage can be effectively used as a part of the storage region that stores the control unit.

In the aspect of the present invention, preferably, the supporting wall includes a main wall and an auxiliary wall provided outside the main wall, and the main wall divides the region more rearward than the bowl into the upper region and the lower region, and the auxiliary wall includes the inner wall of the skirt dividing the upper region from the internal space of the double wall of the skirt, the auxiliary wall further includes a first communication hole formed on a bottom surface, and the first communication hole communicates between the upper region and the internal space of the double wall of the skirt, and the auxiliary wall further includes a second communication hole formed on the outer wall forming the internal space of the double wall in the side wall or the rear wall of the skirt, and the second communication hole communicates between the internal space of the double wall of the skirt excluding the lower region and outside of the toilet main body. According to the aspect of the present invention having this configuration, through the first communication hole in the bottom surface of the auxiliary wall, to communicate between the upper region of the rear storage in the region more rearward than the bowl of the toilet main body and the internal space of the double wall of the skirt, and through the second communication hole in the outer wall of the side wall or the rear wall of the skirt, to communicate between the internal space of the double wall of the skirt excluding the lower region of the rear storage and the outside of the toilet main body, the upper region of the rear storage can communicate with the outside of the toilet main body through the internal space of the double wall of the side wall or the rear wall of the skirt, without through the lower region of the rear storage. Therefore, in the control unit stored in the upper region of the rear storage, even if water cover or out-of-machine water leakage occurs, water cover or water leakage in the upper region of the rear storage can be discharged to the outside of the toilet main body from the first communication hole in the bottom surface of the auxiliary wall, without through the lower region of the rear storage, and from the second communication hole through the internal space of the double wall of the skirt. Consequently, water leakage from the control unit can be easily confirmed outside of the toilet main body. Also, water leakage or power leakage from the control unit can be prevented from being transmitted to the discharge socket or the like in the discharge socket storage in the lower region of the rear storage, so that fire resistance in the lower region of the rear storage can be inhibited from being affected.

In the aspect of the present invention, preferably, the double wall in the rear wall of the skirt forming the opening includes a bottom portion contactable with a floor in a state where the toilet main body is installed, the bottom portion includes a concave portion being upwardly concave to separate the lower region from the outside of the toilet main body, and the second communication hole is formed penetrating the concave portion to communicate between the internal space of the double wall of the skirt excluding the lower region and the outside of the toilet main body. According to the aspect of the present invention having this configuration, in the control unit stored in the upper region of the rear storage, even if water cover or out-of-machine water leakage occurs, water cover or water leakage in the upper region of the rear storage can be discharged from the first communication hole in the bottom surface of the auxiliary wall and through the internal space of the double wall of the skirt that forms the opening, without through the lower region of the rear storage. Afterward, the water cover or water leakage in the internal space of the double wall in the rear wall of the skirt can be discharged from the second communication hole to the floor outside of the toilet main body. Therefore, water cover or water leakage in the control unit can be easily confirmed with water leakage in the floor outside of the toilet main body. Furthermore, the concave portion of the bottom portion of the double wall in the rear wall of the skirt that forms the opening separates the lower region of the rear storage from the outside of the toilet main body, so that water leakage or power leakage from the control unit can be prevented from being transmitted to the discharge socket or the like in the discharge socket storage in the lower region of the rear storage. Therefore, water cover or out-of-machine water leakage in the control unit can be inhibited from affecting fire resistance in the lower region of the rear storage and for the discharge socket.

According to a flush toilet of an aspect of the present invention, a large storage region that stores a control unit can be acquired in a region more rearward than a bowl of a toilet main body, while suppressing an external dimension of the whole toilet main body.

DETAILED DESCRIPTION OF THE PREFERRED EMBODIMENT

Figure 1:
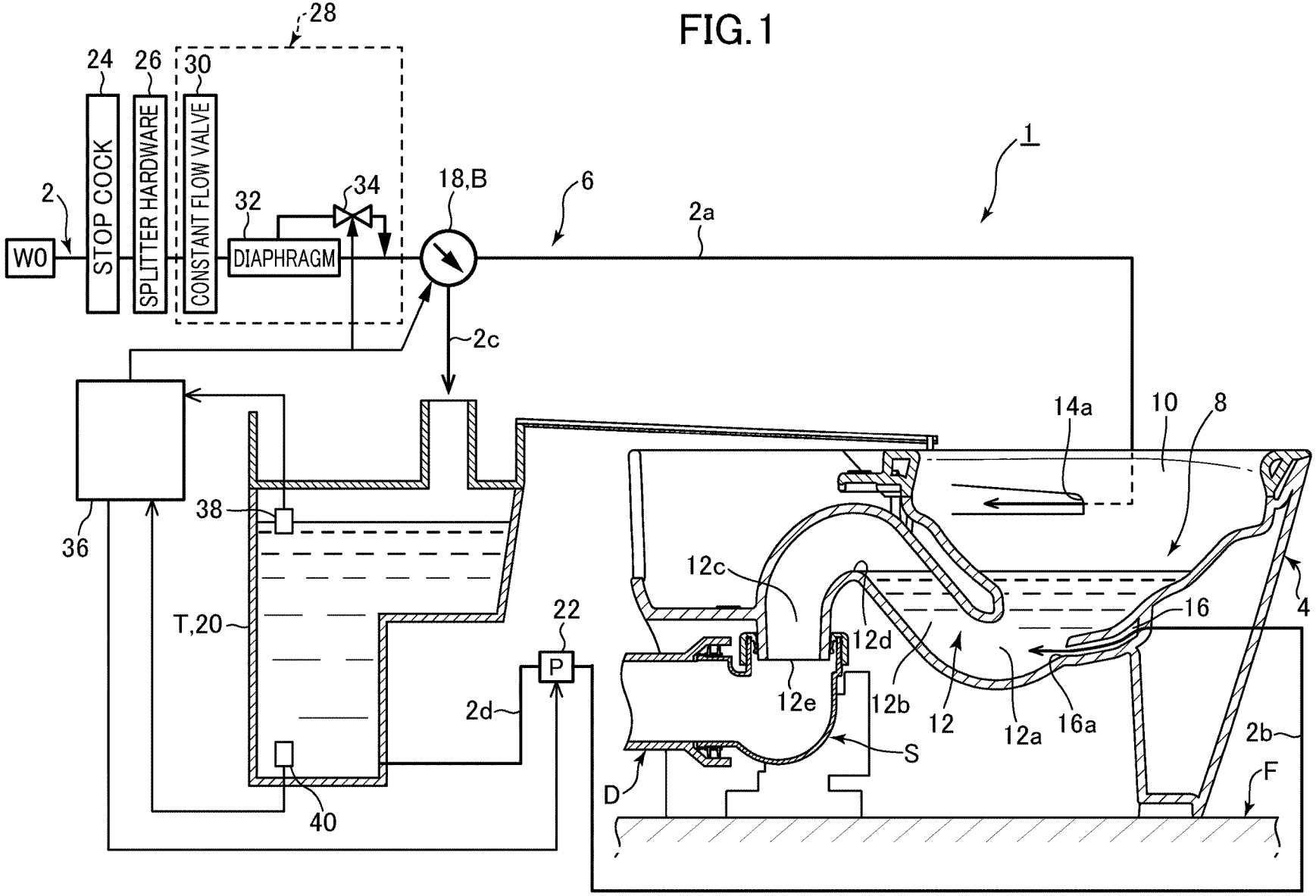
FIG. 1 is an overall structural diagram of a flush toilet according to an embodiment of the present invention.
Figure 2:
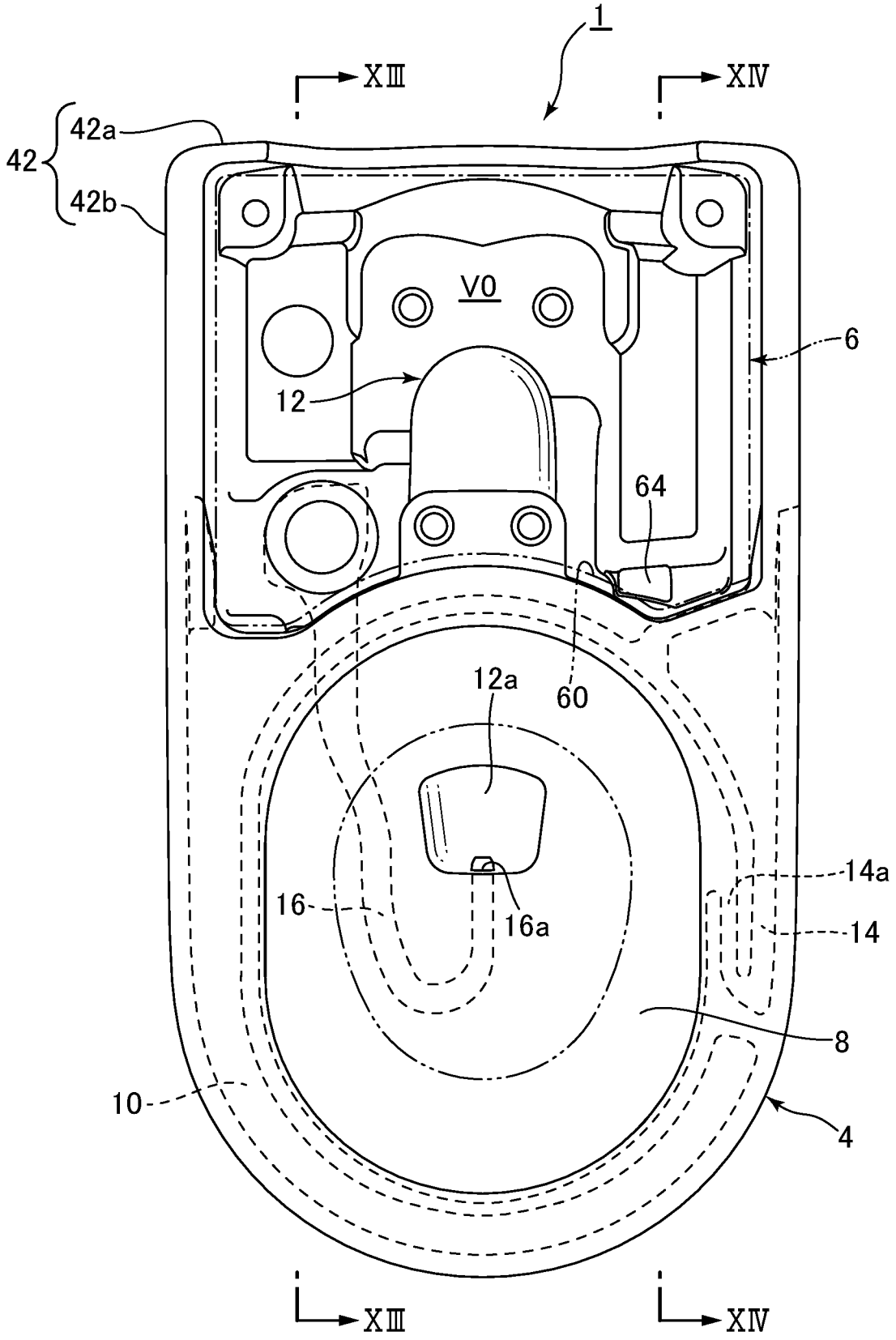
FIG. 2 is a plan view of the flush toilet according to the embodiment of the present invention.
Figure 3:
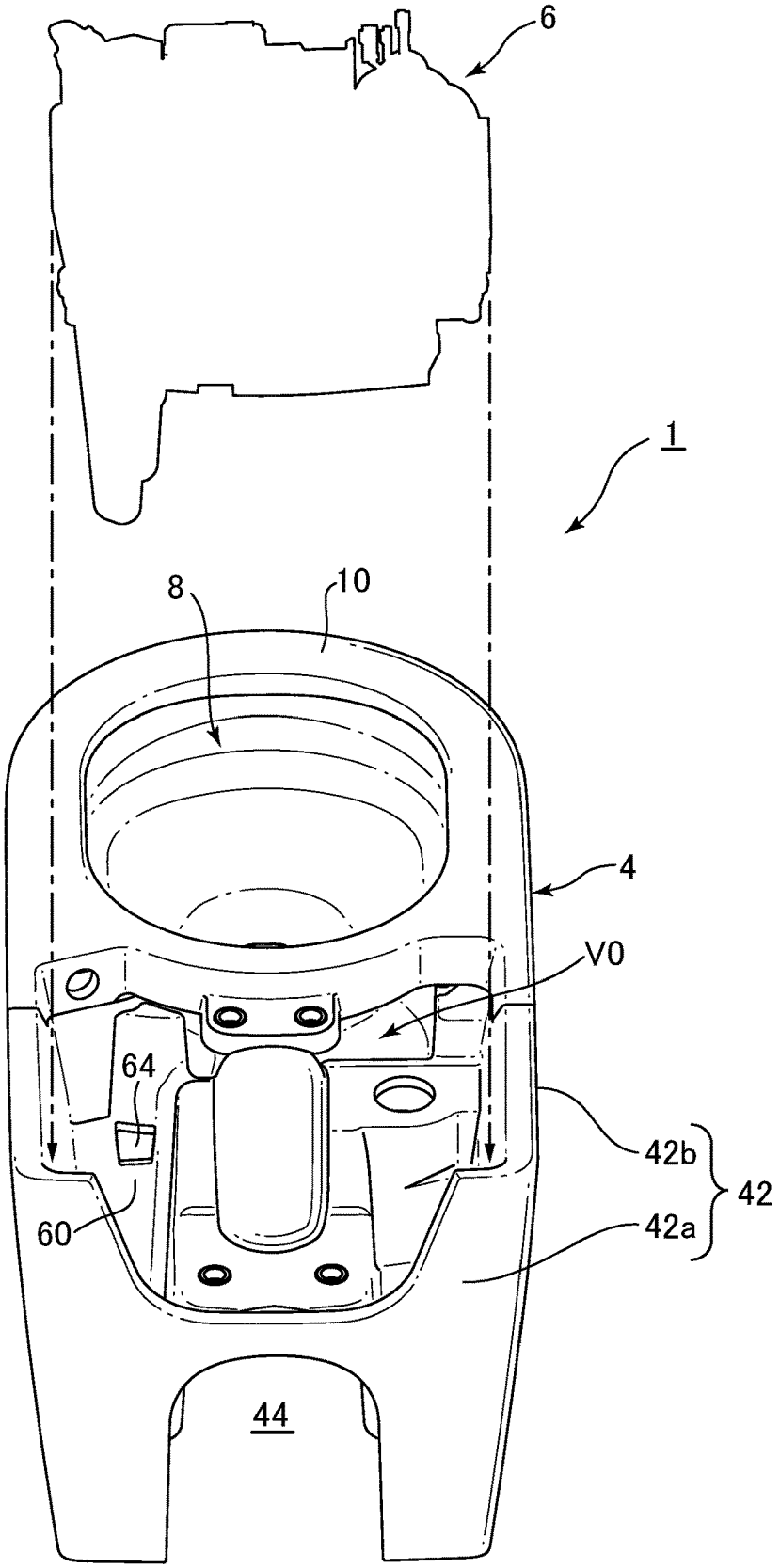
FIG. 3 is an exploded perspective view of the flush toilet according to the embodiment of the present invention seen from rear and diagonally above.
Figure 4:
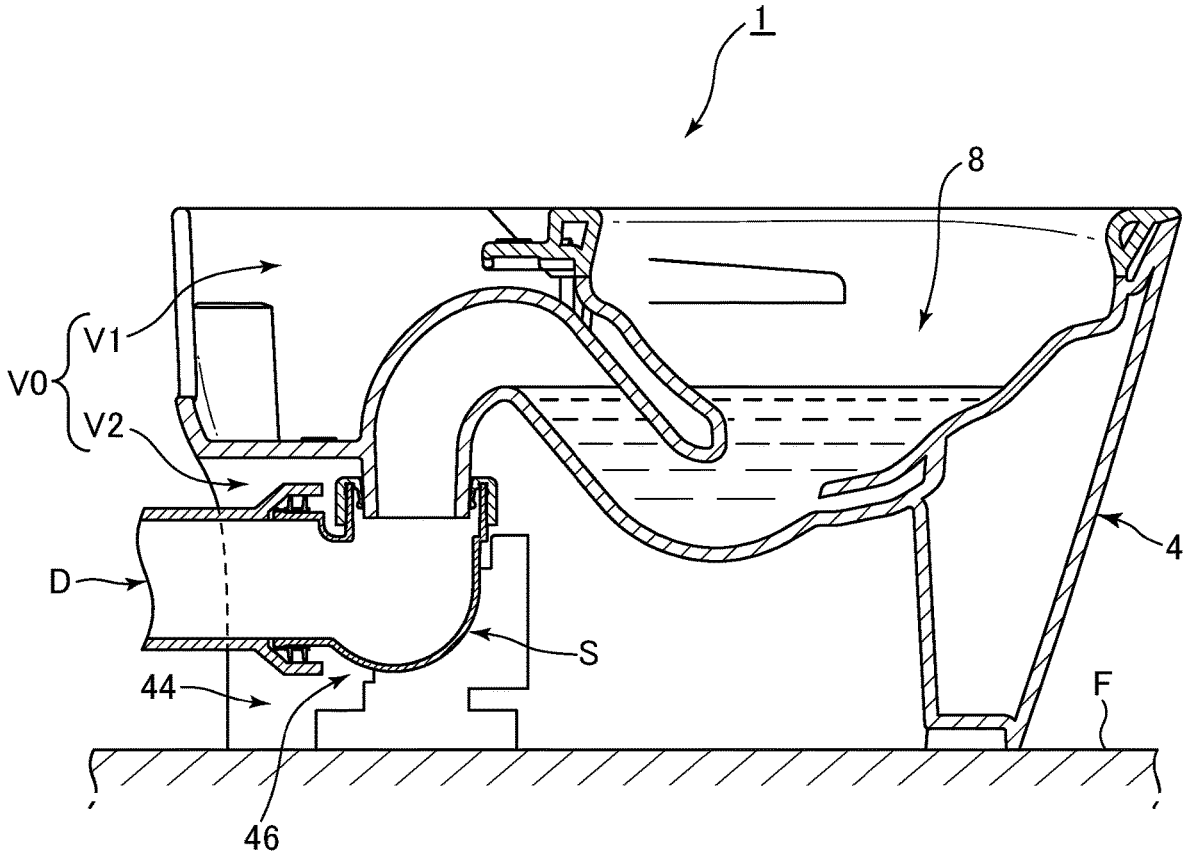
FIG. 4 is a center side surface cross-sectional view of the flush toilet according to the embodiment of the present invention, showing a state where a discharge socket and a drain pipe are connected to a toilet main body.

Hereinafter, a flush toilet according to an embodiment of the present invention will be described with reference to the accompanying drawings. First, an entire configuration of the flush toilet according to the embodiment of the present invention will be schematically described with reference to FIGS. 1 to 3. As shown in FIGS. 1 to 3, a flush toilet 1 according to the embodiment of the present invention includes a water supply channel (a main water passageway 2) where flush water that is supplied from a main water supply source WO such as a water system flows through, a toilet main body 4 made of ceramics, and a flush water supply device 6.

Next, as shown in FIGS. 1 to 3, the toilet main body 4 includes a bowl 8 for receiving waste, a rim 10 that is formed at a top edge of the bowl 8, and a water discharge trap 12 extending from a bottom portion of the bowl 8. Furthermore, as shown in FIGS. 1 to 3, although details will be given later, the flush water supply device 6 is a control unit that is provided more rearward than the bowl 8 of the toilet main body 4 and that enables flush water supplied from the main water passageway 2 to be supplied to the toilet main body 4. More specifically, this control unit includes a function of controlling discharge and stopping of flush water to the bowl 8 of the toilet main body 4 by operating on power.

Next, as shown in FIG. 2, a rim conduit 14 is formed in the rim 10 on one of left and right sides of the toilet main body 4 (right side of the toilet main body 4 seen from front). The rim conduit 14 has a so-called U-turn shape that extends forward from the rear side of the toilet main body 4 and then bends rearward, in the rim 10 on one of the left and right sides of the toilet main body 4 (right side of the toilet main body 4 seen from front). Further, a rim spout port 14*a* is provided on a downstream end (downstream rear end) of the rim conduit 14. Furthermore, a rim-side water supply channel 2*a* of the flush water supply device 6, of which more later, is connected on an upstream side of the rim conduit 14 of the toilet main body 4. Flush water that is supplied from the rim-side water supply channel 2*a* to the rim spout port 14*a* is discharged into the bowl 8, rearward from the rim spout port 14*a*, and rim spouting is thus performed.

Next, as shown in FIGS. 1 and 2, a jet conduit 16 is formed extending from an outer surface of the bowl 8 of the toilet main body 4 to the bottom portion. A downstream side of the jet conduit 16 faces an inlet 12*a* of the water discharge trap 12 at the bottom portion of the bowl 8, and a jet spout port 16*a* is provided on a downstream end of the jet conduit 16. Furthermore, a jet-side water supply channel 2*b* of the flush water supply device 6, of which more later, is provided on an upstream side of the jet conduit 16 of the toilet main body 4. Flush water that is supplied from the jet-side water supply channel 2*b* to the jet conduit 16 of the toilet main body 4 is spouted from the jet spout port 16*a* toward the inlet 12*a* of the water discharge trap 12, and jet spouting is thus performed. Now, as shown in FIG. 1, an upstream side of the rim-side water supply channel 2*a* of the flush water supply device 6 is connected to a switching valve 18 (of which more later) at a branch part B on the main water passageway 2. For its part, an upstream side of the jet-side water supply channel 2*b* of the flush water supply device 6 is connected to a pressure pump 22 (of which more later) of the flush water supply device 6 provided on a downstream side of a storage tank 20 of the flush water supply device 6, as shown in FIG. 1.

Next, the water discharge trap 12 of the toilet main body 4 includes the inlet 12*a* provided at the bottom portion of the bowl 8, an ascending pipe 12*b* that ascends from the inlet 12*a*, and a descending pipe 12*c* that descends from the ascending pipe 12*b*, and a part between the ascending pipe 12*b* and the descending pipe 12*c* is a top portion 12*d*. Also, as shown in FIG. 1, an outlet 12*e* of the descending pipe 12*c* of the water discharge trap 12 is connected to an inlet of a discharge socket S that is disposed behind and below the toilet main body 4. Furthermore, as shown in FIG. 1, an outlet of the discharge socket S on the rear side is connected to an inlet of a drain pipe D extending from a wall (not shown) on the rear side of the toilet main body 4. Consequently, a so-called water discharge mode of "wall side water discharge" is formed where water discharged through the outlet 12*e* of the water discharge trap 12 of the toilet main body 4 is discharged from the discharge socket S to the drain pipe D on a wall side. Additionally, the flush toilet 1 of the present embodiment is not limited to this water discharge mode of "wall side water discharge", and is applicable to a so-called water discharge mode of "floor side water discharge" where water discharged through the outlet 12*e* of the water discharge trap 12 of the toilet main body 4 is discharged from the discharge socket S to a drain pipe provided below an installation surface (floor F) of a bottom surface of the toilet main body 4.

Next, each configuration of the flush water supply device 6 of the flush toilet 1 according to the present embodiment will be schematically described with reference to FIG. 1. First, as shown in FIG. 1, the flush water supply device 6 includes, from an upstream side to a downstream side of the main water passageway 2, a stop cock 24, splitter hardware 26, a valve unit 28, and the switching valve 18. Next, the valve unit 28 includes a constant flow valve 30, a diaphragm main valve 32, and an electromagnetic valve 34 such as a solenoid valve. Furthermore, the flush water supply device 6 includes a controller 36. The controller 36 is capable of functioning as a controller that controls an opening-closing operation of an on-off valve (the electromagnetic valve 34) of the valve unit 28, a switching operation of the switching valve 18, and a rotational speed, an operation time, and the like of the pressure pump 22.

Moreover, the constant flow valve 30 of the valve unit 28 is for reducing flush water passing from the stop cock 24 on the main water passageway 2 and through the splitter hardware 26 to or below a predetermined flow rate. Additionally, in a mode where the flush toilet 1 is provided with a private part washing device (not shown), a water supply pipe (not shown) for supplying flush water to the private part washing device (not shown) may also be connected to the splitter hardware 26. Furthermore, at the valve unit 28, when an opening operation is performed on the electromagnetic valve 34 by the controller 36, the main valve 32 is opened, and flush water passing from the constant flow valve 30 and through the main valve 32 is supplied to the switching valve 18 at the branch part B on the downstream side of the main water passageway 2. The switching valve 18 is capable of supplying flush water from the main water passageway 2 to the rim-side water supply channel 2*a* and a tank-side water supply channel 2*c* at a same timing, and a ratio between water supplied to the rim side and water supplied to the tank side may be freely changed.

Next, the flush water supply device 6 includes a tank device T that enables flush water supplied from the main water passageway 2 to be supplied to the toilet main body 4. The tank device T includes the storage tank 20 that is coupled to a rear side of the toilet main body 4 and that is for storing flush water supplied from the main water passageway 2, and the pump (the pressure pump 22) for feeding the flush water in the storage tank 20 to the toilet main body 4 under pressure. Furthermore, the rim-side water supply channel 2*a* that communicates with the rim conduit 14 of the toilet main body 4, and the tank-side water supply channel 2*c* that is connected to the storage tank 20 are provided on the downstream side of the branch part B on the downstream side of the main water passageway 2. Accordingly, flush water that is supplied from the main water supply source WO to the branch part B of the main water passageway 2 is used as water to be supplied to at least one of the rim-side water supply channel 2*a* to be supplied to the rim and the tank-side water supply channel 2*c* to be supplied to the tank.

Furthermore, the flush water supply device 6 includes a pump water supply channel 2*d* that extends from a downstream side of the tank-side water supply channel 2*c* to the pressure pump 22, and the jet-side water supply channel 2*b* that extends on a downstream side from the pressure pump 22. Accordingly, with the flush toilet 1 of the present embodiment, flush water that is supplied from the main water passageway 2 and that is directly under tap water pressure may be supplied from the rim-side water supply channel 2*a* of the flush water supply device 6 to the rim spout port 14*a*, via the rim conduit 14 of the toilet main body 4, and water may thus be spouted from the rim spout port 14*a* (so-called "rim spouting"). Furthermore, the flush water supplied from the main water passageway 2 to the flush water supply device 6 may flow through the tank-side water supply channel 2*c*, the storage tank 20, the pump water supply channel 2*d* and the pressure pump 22 of the flush water supply device 6 and then be supplied from the jet-side water supply channel 2*b* to the jet spout port 16*a*, via the jet conduit 16 of the toilet main body 4, and water may thus be spouted from the jet spout port 16*a* (so-called "jet spouting"). That is, the flush toilet 1 of the present embodiment may function as a so-called hybrid flush toilet 1 that is capable of using, in combination, rim spouting that uses flush water that is supplied from the main water passageway 2 and that is directly under tap water pressure, and jet spouting that uses flush water that is from the storage tank 20 and that is pressurized by the pressure pump 22.

Now, an upper float switch 38 and a lower float switch 40 are disposed inside the storage tank 20. A water level inside the storage tank 20 may be detected by these float switches 38, 40. For example, the upper float switch 38 is switched on when the water level inside the storage tank 20 reaches a predetermined water storage level, and the controller 36 detects an on state of the upper float switch 38 and causes the electromagnetic valve 34 to close. For its part, the lower float switch 40 is switched on when the water level inside the storage tank 20 falls to a predetermined water level below the predetermined water storage level that is detected by the upper float switch 38, and the controller 36 detects an on state of the lower float switch 40 and causes the pressure pump 22 to stop. Furthermore, the pressure pump 22 is for causing flush water stored in the storage tank 20 to be discharged from the jet spout port 16*a*, by suctioning the flush water into the pump water supply channel 2*d* and pressurizing the flush water in the pump water supply channel 2*d* into the jet-side water supply channel 2*b*.

With the structures described above, at a time of normal toilet flushing, the controller 36 detects an operation of a toilet flushing switch (not shown) by a user, for example, and causes the electromagnetic valve 34, the switching valve 18, and the pressure pump 22 to sequentially operate. Discharging of water from the rim spout port 14*a* and the jet spout port 16*a* is thus sequentially started, and flush water used to flush the bowl 8 is discharged from the water discharge trap 12, together with waste in the bowl 8. Furthermore, when flushing is over, the controller 36 opens the electromagnetic valve 34, and the switching valve 18 is switched to the tank-side water supply channel 2*c* side, and flush water in the main water passageway 2 is used to refill the storage tank 20. Then, when the water level inside the storage tank 20 rises and the upper float switch 38 detects a specified water storage amount, the controller 36 closes the electromagnetic valve 34, so that the main valve 32 closes the main water passageway 2, and supply of water is thereby stopped. Moreover, each unit of the flush water supply device 6 (control unit) is stored in a rear storage V0 (of which more later) in a region more rearward than the bowl 8 of the toilet main body 4.

Next, specific description will be given to the rear storage V0 where the flush water supply device 6 (control unit) is stored in the toilet main body 4 of the flush toilet 1 according to the present embodiment, and a peripheral structure of the rear storage V0 with reference to FIGS. 2 to 14. Here, the flush toilet 1 of the present embodiment shown in FIGS. 4 to 8 does not show the flush water supply device 6.

First, as shown in FIGS. 2 to 8, the toilet main body 4 includes a skirt 42 formed on an outer side than a side surface of each of the bowl 8 and the water discharge trap 12. Also, the rear storage V0 of the toilet main body 4 is provided below an upper end of the skirt 42 and on an inner side than the skirt 42 in the region more rearward than the bowl 8 of the toilet main body 4, to form a storage region that can store at least a part of the flush water supply device 6 (control unit).

Next, as shown in FIGS. 2 to 12, the skirt 42 includes a rear wall 42*a* provided on a back surface of the toilet main body 4, and a side wall 42*b* provided on each of left and right side surfaces of the toilet main body 4 seen from front. Also, a opening 44 to which the drain pipe D is connected is formed to penetrate, in a front-rear direction, a lower portion of a center in a left-right direction seen from front in the rear wall 42*a* of the skirt 42.

Figure 9:
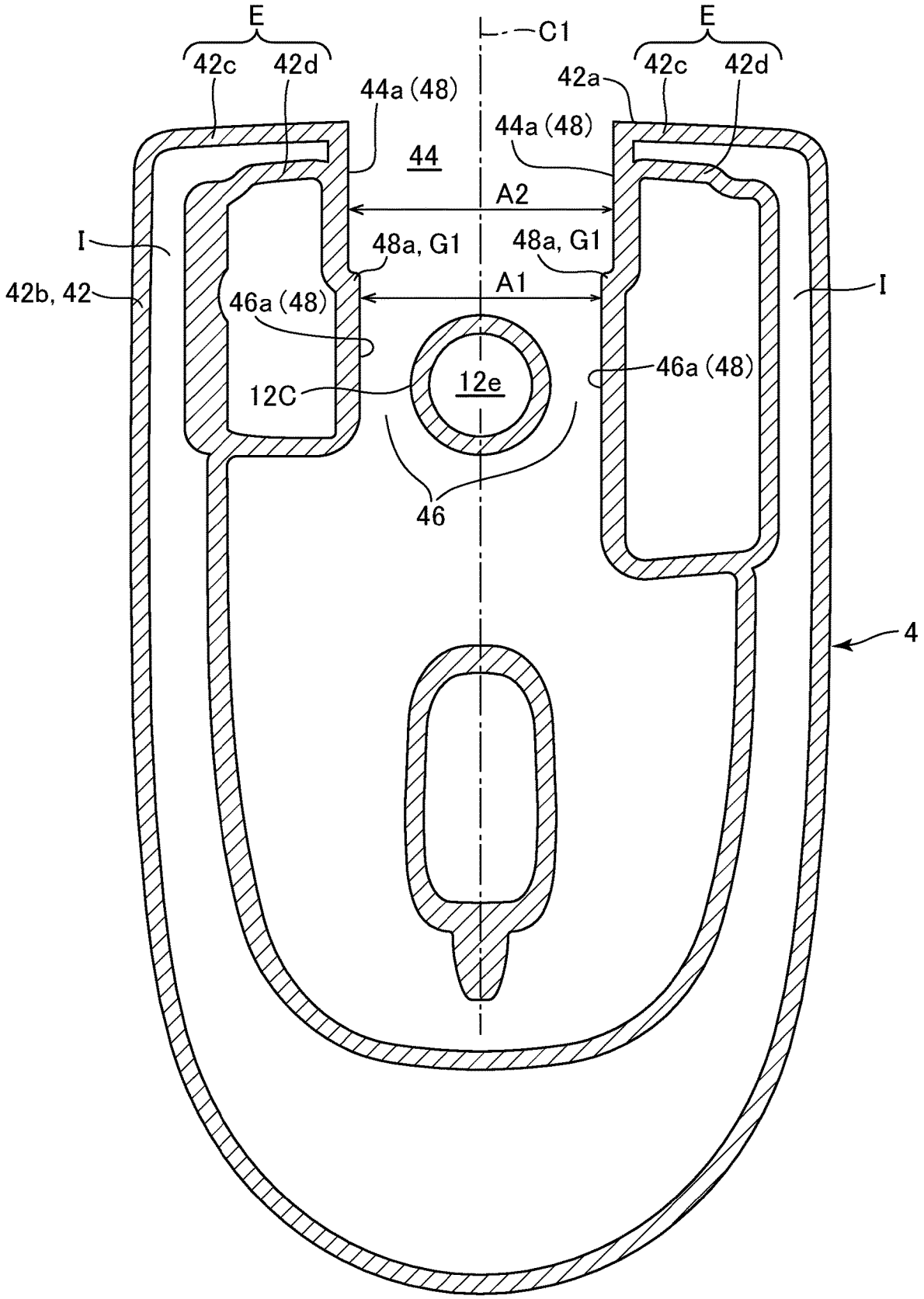
FIG. 9 is a cross-sectional view taken along a line IX-IX of FIG. 8.

Also, as shown in FIGS. 4 to 9, a discharge socket storage 46 is formed on a front side of the opening 44 in a lower region of a center of the rear storage V0 in the left-right direction in the toilet main body 4. The discharge socket storage 46 functions as a storage region that can store the discharge socket S connected to the outlet 12*e* of the descending pipe 12*c* of the water discharge trap 12. Furthermore, as shown in FIG. 9, each of left and right side wall surfaces 46*a* (a first side wall surface) that form an interior of the discharge socket storage 46 protrudes more toward an opening center direction of the opening 44 (a direction of an opening central axis C1 of the opening 44 in plan view of FIG. 9) than each of left and right side wall surfaces 44*a* (a second side wall surface) that form an interior of the opening 44. Consequently, an opening cross-sectional area A1 of the discharge socket storage 46 is reduced to be smaller than an opening cross-sectional area A2 of the opening 44 (A1<A2).

Figure 5:
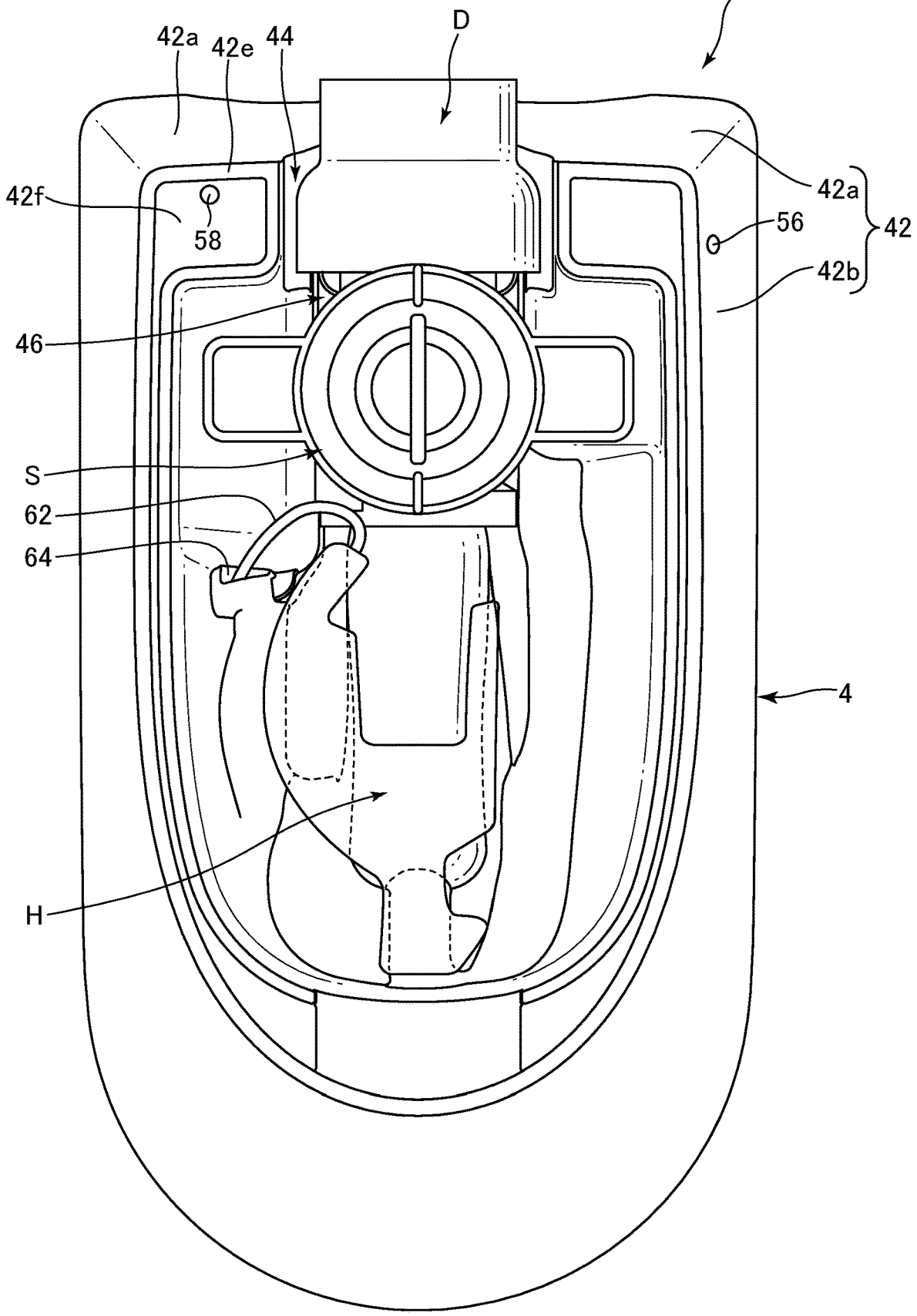
FIG. 5 is a bottom view of the flush toilet according to the embodiment of the present invention, showing the state where the discharge socket and the drain pipe are connected to the toilet main body.
Figure 6:
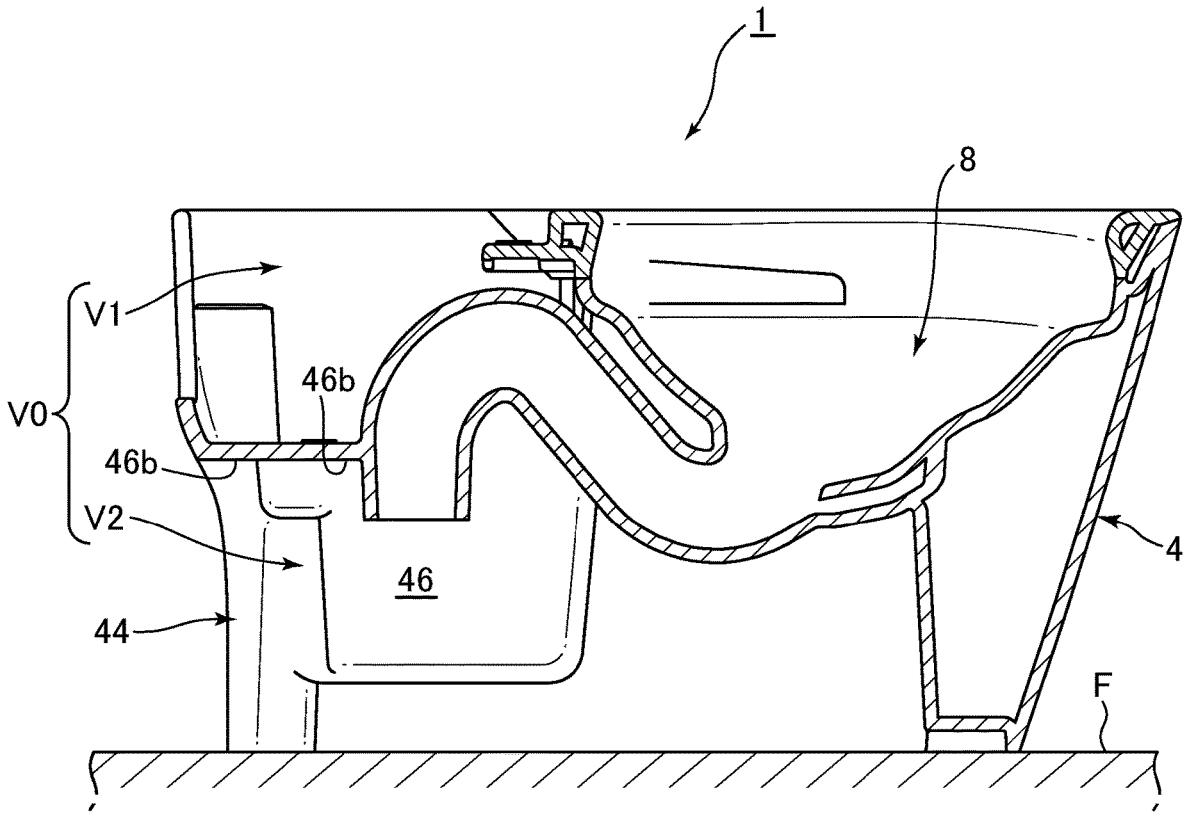
FIG. 6 is a center side surface cross-sectional view of the flush toilet according to the embodiment of the present invention, showing a state where the discharge socket and the drain pipe are not connected to the toilet main body.
Figure 7:
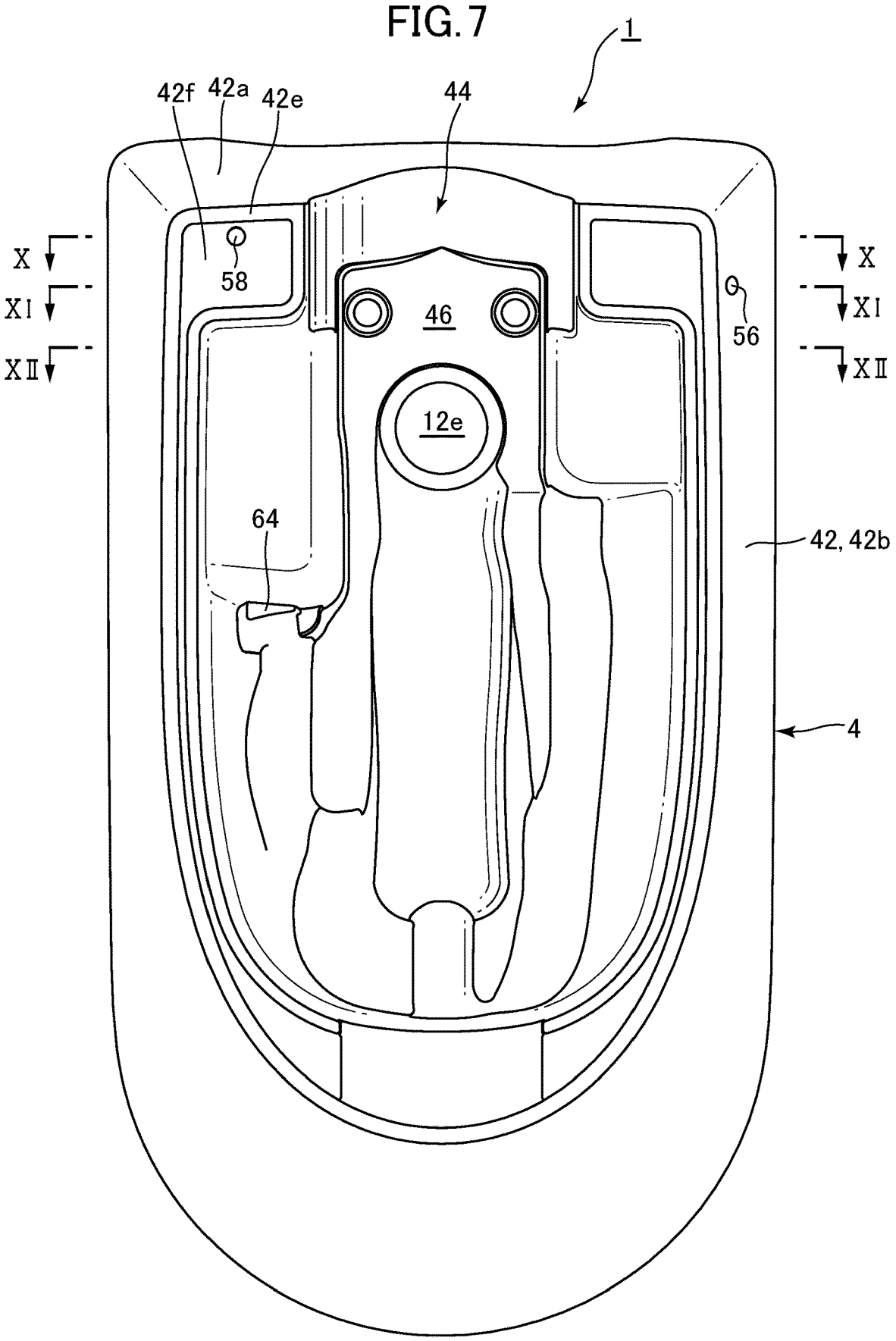
FIG. 7 is a bottom view of the flush toilet according to the embodiment of the present invention, showing the state where the discharge socket and the drain pipe are not connected to the toilet main body.
Figure 8:
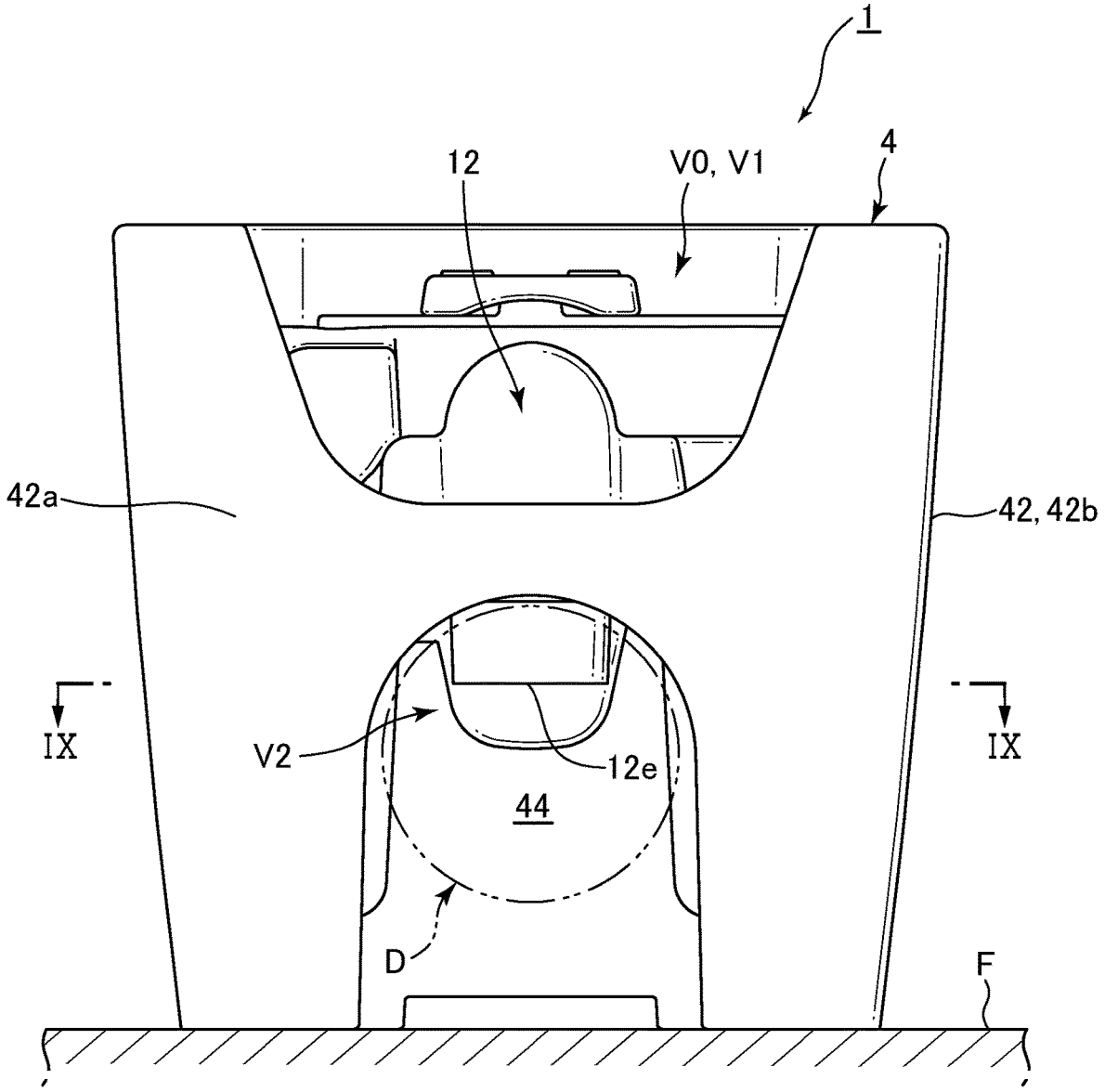
FIG. 8 is a back view of the flush toilet according to the embodiment of the present invention.

Additionally, as shown in FIG. 5, a heater device H for cold district specifications is provided on an outer surface of a bottom portion of each of the inlet 12*a* of the water discharge trap 12 and the jet spout port 16*a* that are located on a front side of the discharge socket storage 46. Here, FIG. 7 shows the flush toilet 1 in a state where the heater device H mounted to the toilet main body 4 shown in FIG. 5 is removed. Note that in a case of using the flush toilet 1 of the present embodiment for specifications other than the cold district specifications, the heater device H may be omitted.

Figure 10:
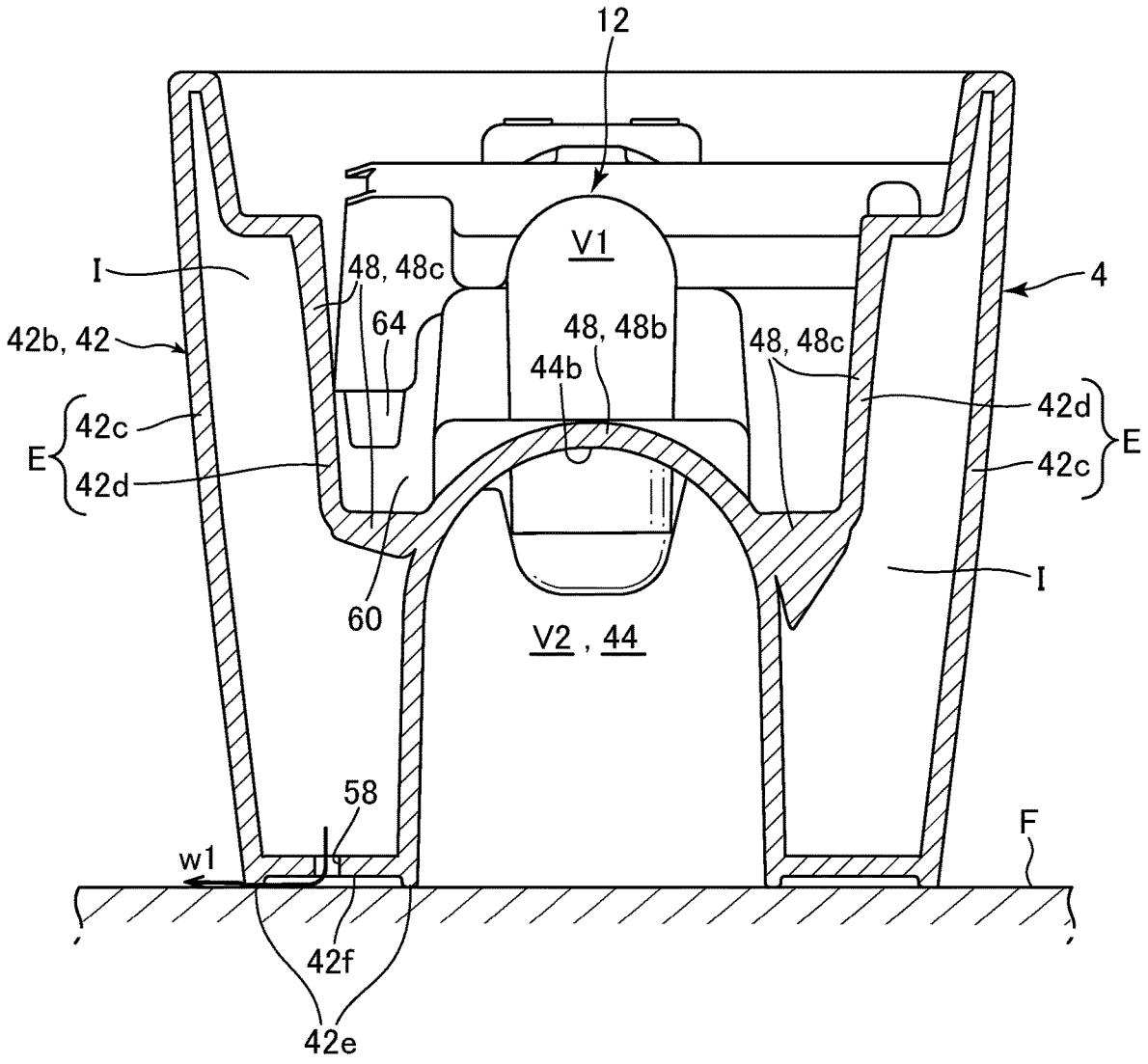
FIG. 10 is a cross-sectional view taken along a line X-X of FIG. 7.
Figure 11:
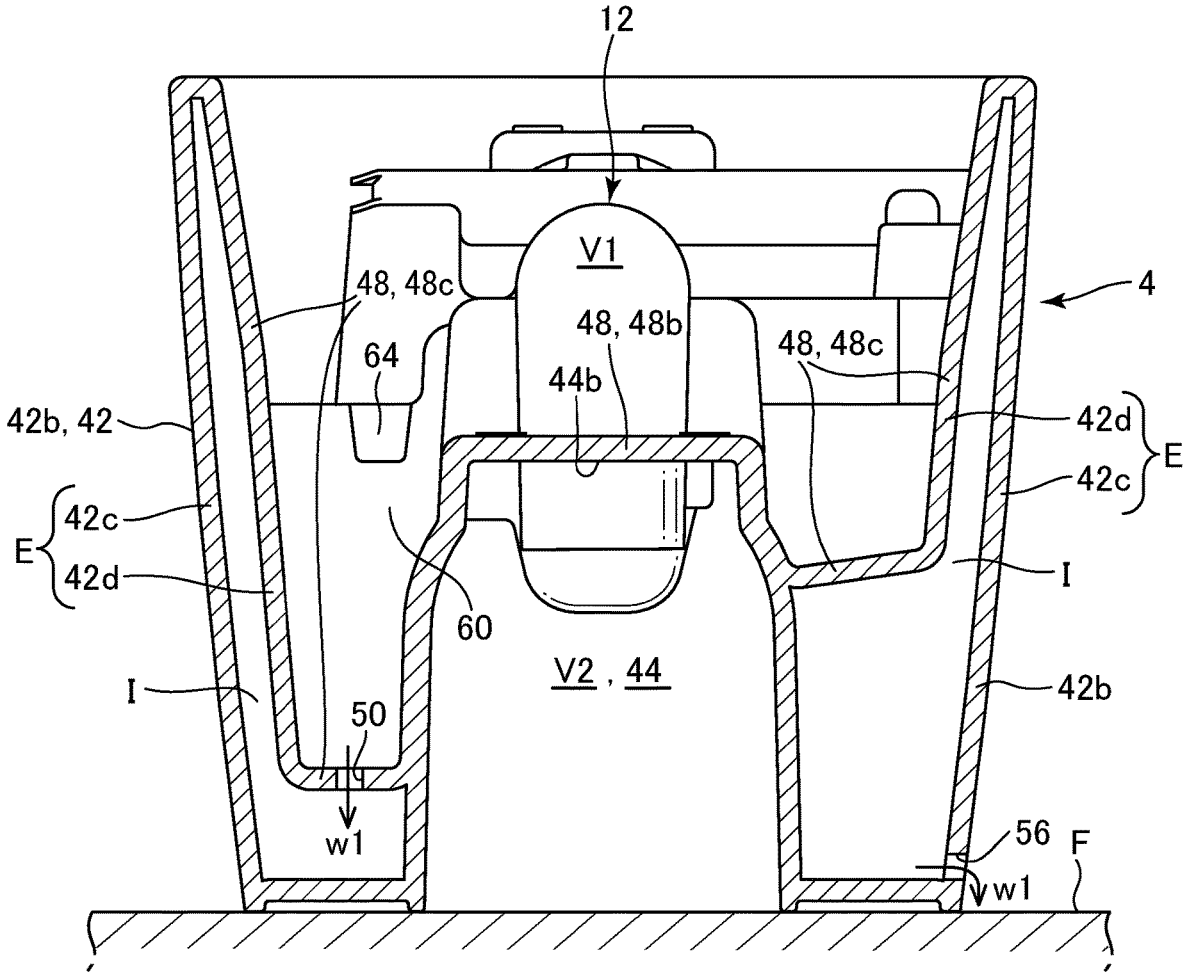
FIG. 11 is a cross-sectional view taken along a line XI-XI of FIG. 7.
Figure 12:
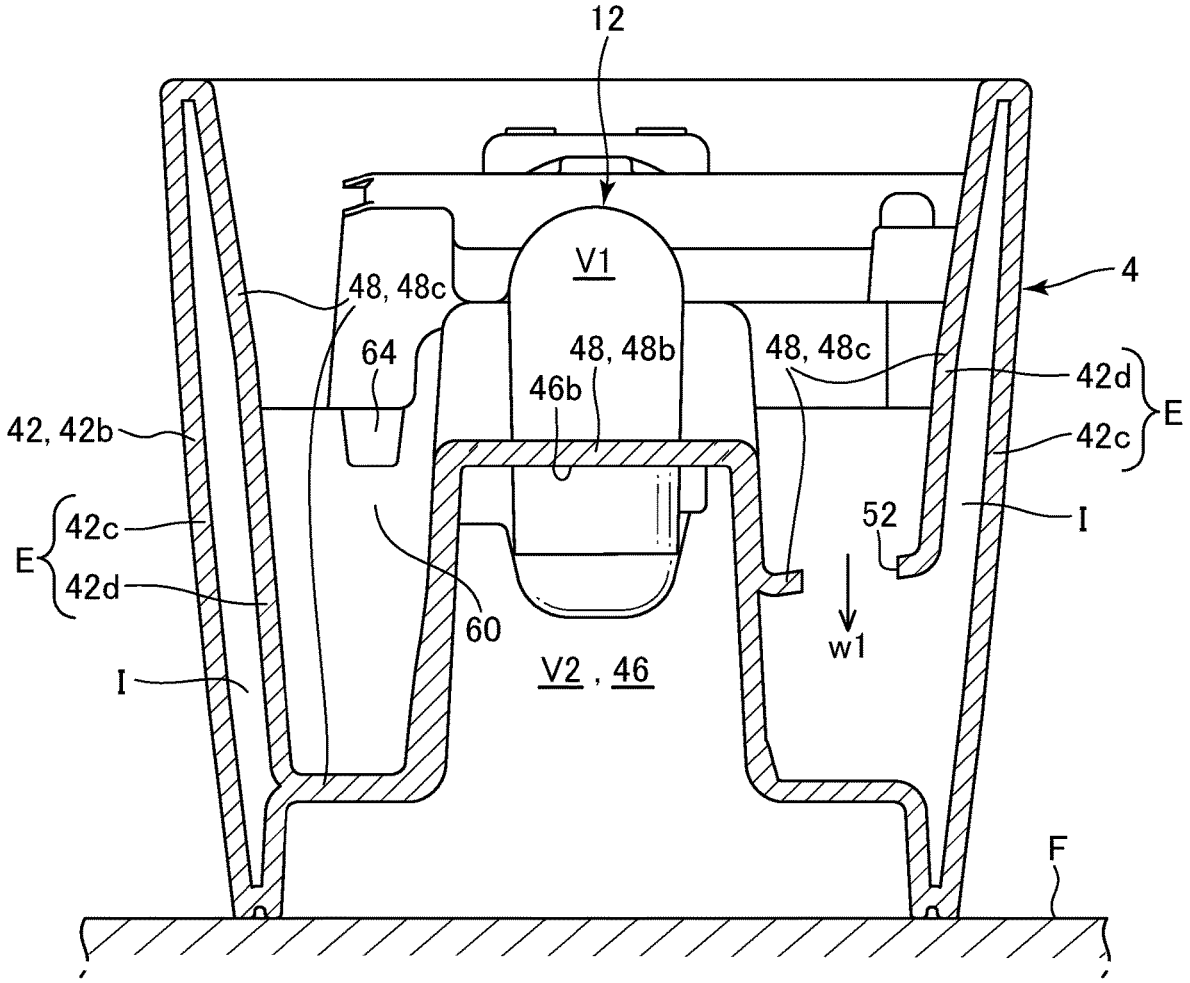
FIG. 12 is a cross-sectional view taken along a line XII-XII of FIG. 7.

Next, as shown in FIGS. 10 to 12, the rear storage V0 includes a supporting wall 48 that supports the flush water supply device 6 (control unit). This supporting wall 48 divides, in an up-down direction, a region more rearward than the bowl 8 of the toilet main body 4 to form an upper region V1 and a lower region V2. Also, the upper region V1 of the rear storage V0 includes a storage region that stores at least a part of the flush water supply device 6 (control unit), and the lower region V2 of the rear storage V0 includes an open region of each of the opening 44 and the discharge socket storage 46. Furthermore, as shown in FIGS. 9 to 12, the supporting wall 48 includes the left and right side wall surfaces 46*a* (first side wall surfaces) that form the interior of the discharge socket storage 46, the left and right side wall surfaces 44*a* (second side wall surfaces) that form the interior of the opening 44, and joining portions 48*a* each of which joins each side wall surface 46*a* (the first side wall surface) and each side wall surface 44*a* (the second side wall surface) to each other. The joining portion 48*a* is provided with a step G1 to reduce the opening cross-sectional area A1 of the discharge socket storage 46 to be smaller than the opening cross-sectional area A2 of the opening 44. The step G1 allows the side wall surface 46*a* (the first side wall surface) of the discharge socket storage 46 to protrude more in the center direction of the opening (the direction of the opening central axis C1 of the opening 44 in plan view of FIG. 9) than the side wall surface 44*a* (the second side wall surface) of the opening 44.

Next, as shown in FIGS. 9 to 12, the rear wall 42*a* and the side wall 42*b* of the skirt 42 form a double wall E including an outer wall 42*c* that forms an outer surface of the skirt 42 and an inner wall 42*d* that is provided inside the outer wall 42*c*. Also, the double wall E forms an internal space I between the outer wall 42*c* and the inner wall 42*d*. Further, as shown in FIG. 9, a peripheral wall that forms the side wall surface 44*a* on a rear side of the opening 44 is formed by the double wall E including the outer wall 42*c* and the inner wall 42*d* that form the rear wall 42*a* of the skirt 42. Also, as shown in FIGS. 6 and 10 to 12, a top surface 44*b* in the opening 44 and a top surface 46*b* in the discharge socket storage 46 are at about the same height position as each other and formed to be flush with each other.

Figure 13:
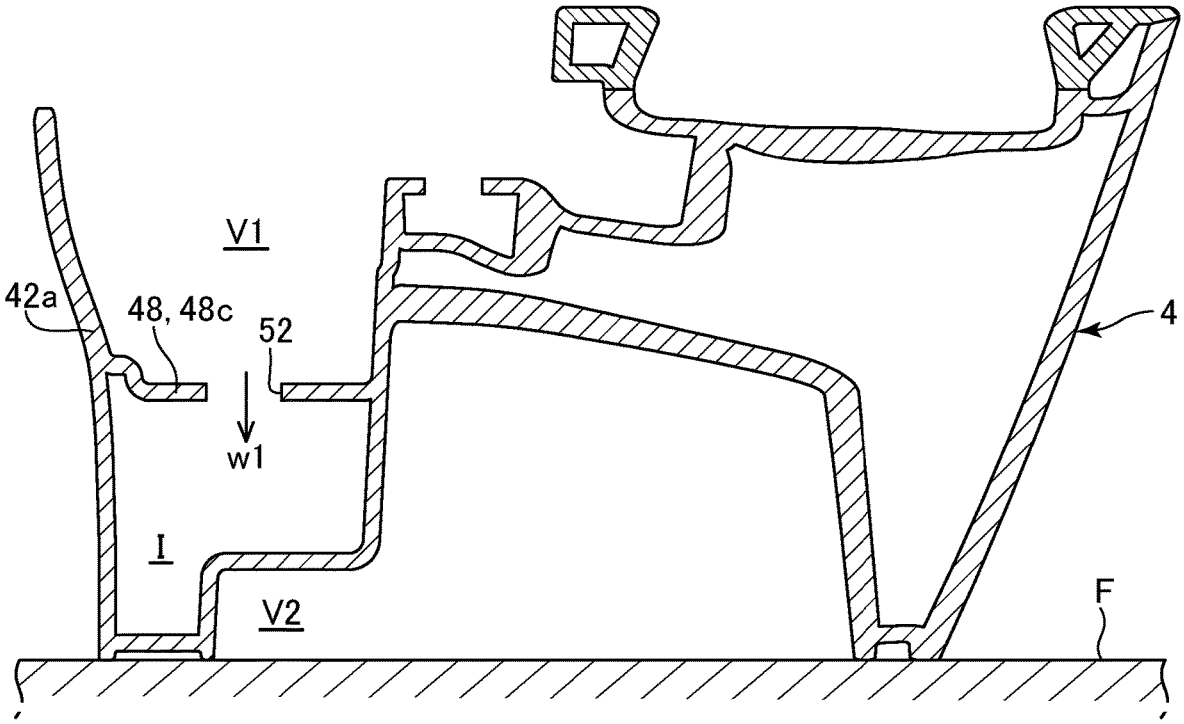
FIG. 13 is a cross-sectional view taken along a line XIII-XIII of FIG. 2.
Figure 14:
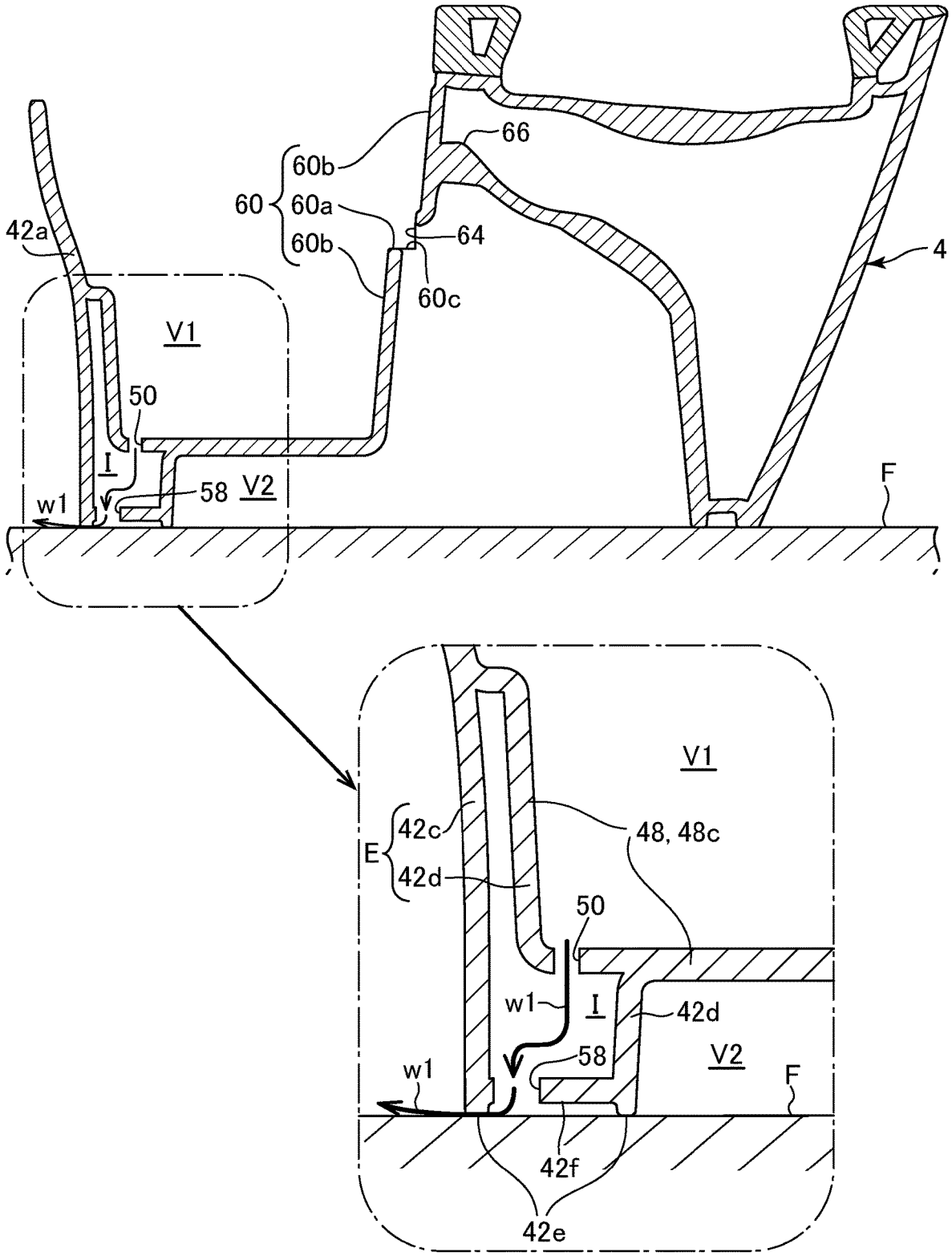
FIG. 14 is a cross-sectional view taken along a line XIV-XIV of FIG. 2.

Next, FIG. 13 is a cross-sectional view taken along a line XIII-XIII of FIG. 2. Also, FIG. 14 is a cross-sectional view taken along a line XIV-XIV of FIG. 2. As shown in FIGS. 9 to 14, the supporting wall 48 of the rear storage V0 of the toilet main body 4 includes a main wall 48*b* that divides the region more rearward than the bowl 8 into the upper region V1 and the lower region V2. Also, the supporting wall 48 includes an auxiliary wall 48*c* that is provided outside of the main wall 48*b*. The auxiliary wall 48*c* includes the inner wall 42*d* of the skirt 42 that divides the upper region V1 from the internal space I of the double wall E of the skirt 42. Furthermore, as shown in FIGS. 11 to 13, in left and right bottom surfaces in the auxiliary walls 48*c*, communication holes 50 and 52 (first communication holes) that communicate between the upper region V1 and the internal space I of the double wall E of the skirt 42 are formed, respectively. Additionally, as shown in FIGS. 3, 5, 7, 8, 11 and 13, in the outer wall 42*c* that forms the internal space I of the double wall E in each of the rear wall 42*a* and the side wall 42*b* of the skirt 42, a communication hole 56 and 58 (a second communication hole) that communicates between the internal space I of the double wall E of the skirt 42 excluding the lower region V2 and outside of the toilet main body 4 is formed.

Next, as shown in FIGS. 5, 7, 10 and 14, the double wall E in the rear wall 42*a* of the skirt 42 that forms the opening 44 includes a bottom portion 42*e* that is contactable with a floor F in a state where the toilet main body 4 is installed. Also, in the bottom portion 42*e*, a concave portion 42*f* that is upwardly concave to separate the lower region V2 of the rear storage V0 from the outside of the toilet main body 4 is formed. Further, in the concave portion 42*f*, the communication hole 58 (the second communication hole) is formed penetrating in the up-down direction. The communication hole 58 can communicate between the internal space I of the double wall E of the skirt 42 excluding the lower region V2 of the rear storage V0 and the outside of the toilet main body 4.

Through the first communication holes 50 and 52 and the second communication holes 56 and 58, the upper region V1 of the rear storage V0 can communicate with the outside of the toilet main body 4 through the internal space I of the double wall E of the rear wall 42*a* or the side wall 42*b* of the skirt 42, without through the lower region V2 of the rear storage V0. Consequently, in the flush water supply device 6 stored in the upper region V1 of the rear storage V0, even if water cover or out-of-machine water leakage occurs, water cover or water leakage w1 in the upper region V1 of the rear storage V0 can be discharged to the outside of the toilet main body 4 from the first communication holes 50 and 52 in the bottom surface of the auxiliary wall 48*c*, without through the lower region V2 of the rear storage V0, and from the second communication holes 56 and 58 through the internal space I of the double wall E of the skirt 42. Note that in the flush toilet 1 of the present embodiment, description is made as to a mode where the second communication hole 56 is provided in the outer wall 42*c* of the side wall 42*b* in the skirt 42 of the toilet main body 4, and the second communication hole 58 is provided in the concave portion 42*f* in the bottom portion 42*e* of the rear wall 42*a* of the skirt 42, but one of the communication hole 56 or 58 may be omitted.

Next, as shown in FIGS. 2, 3, 5, 7, 10 to 12 and 14, in a front wall surface 60 of the upper region V1 in the rear storage V0 of the toilet main body 4, an insertion hole 64 into which a heater cord 62 of the heater device H can be inserted is provided. The insertion hole 64 is set in such a manner that a difference in height between the heater device H mounted to an outer surface in a vicinity of the bottom portion of each of the inlet 12*a* of the water discharge trap 12 and the jet spout port 16*a* and the insertion hole 64 is comparatively small. Consequently, the heater device H and the insertion hole 64 are close to each other and set in such a manner that a distance between each other is comparatively small. Also, the wall surface 60 provided with the insertion hole 64 is a vertical wall surface that extends in the up-down direction. In this case, as compared with a case where the insertion hole 64 is provided in a flat wall surface, a comparatively large storage volume of the upper region V1 in the rear storage V0 can be acquired. Here, in the wall surface 60, preferably, a horizontal wall surface 60*a* extending in a horizontal direction and a vertical wall surface 60*b* extending in the up-down direction form a step 60*c*, and the insertion hole 64 is formed in a part of the horizontal wall surface 60*a* and vertical wall surface 60*b* in the step 60*c*. Consequently, a range where a flat surface for the insertion hole 64 is formed can be narrowed. Therefore, while acquiring the comparatively large storage volume of the upper region V1 in the rear storage V0 even more, the difference in height between the heater device H mounted to the outer surface in the vicinity of the bottom portion of each of the inlet 12*a* of the water discharge trap 12 and the jet spout port 16*a* and the insertion hole 64 can be set to be comparatively small. Furthermore, as shown in FIG. 14, in the wall surface 60 above the insertion hole 64, a supporting wall 66 extending forward in a plane is provided. Consequently, deformation such as cutting can be suppressed by increasing strength of the toilet main body 4 made of ceramics.

Next, description will be given to operation of the flush toilet 1 according to the above embodiment of the present invention with reference to FIGS. 1 to 14. First, according to the flush toilet 1 of the embodiment of the present invention, the rear storage V0 of the toilet main body 4 forms the storage region that is available for storing the control unit (flush water supply device 6) in the region more rearward than the bowl 8. The side wall surface 46*a* (the first side wall surface) in the discharge socket storage 46 below the center of the rear storage V0 in the left-right direction protrudes more in the opening center direction of the opening 44 (the direction of the opening central axis C1 of the opening 44 in plan view of FIG. 9) than the side wall surface 44*a* (the second side wall surface) in the opening 44. Consequently, the opening cross-sectional area A1 of the discharge socket storage 46 can be reduced to be smaller than the opening cross-sectional area A2 of the opening 44. Therefore, in a region from the opening 44 of the toilet main body 4, to which the drain pipe D is connected, to the discharge socket storage 46, a wasted space that is unnecessary in connecting the drain pipe D and the discharge socket S can be reduced. Therefore, a large storage region that stores the control unit (flush water supply device 6) can be acquired in the region more rearward than the bowl 8 of the toilet main body 4, while suppressing an external dimension of the whole toilet main body 4. Also, in the region from the opening 44 of the toilet main body 4, to which the drain pipe D is connected, to the discharge socket storage 46, the wasted space that is unnecessary in connecting the drain pipe D and the discharge socket S is reduced, and a flammable space around the discharge socket S can accordingly be reduced, so that a fire protection performance for the discharge socket S can be improved.

Also, according to the flush toilet 1 of the present embodiment, as shown in FIG. 9, the step G1 provided in the joining portion 48*a* that joins the first side wall surface 46*a* and the second side wall surface 44*a* in the supporting wall 48 to each other allows the first side wall surface 46*a* to protrude more in the center direction of the opening 44 (the direction of the opening central axis C1 of the opening 44 in plan view of FIG. 9) than the second side wall surface 44*a*, and the opening cross-sectional area A1 of the discharge socket storage 46 can be reduced to be smaller than the opening cross-sectional area A2 of the opening 44 (A1<A2). In this case, as compared with a case where the supporting wall 48 is not provided with the step G1, the lower region V2 of the rear storage V0 can be reduced by the step G1, so that the upper region V1 of the rear storage V0 can be acquired more largely. Also, the step G1 is formed and can be used for alignment of the drain pipe D and the discharge socket S, and the drain pipe D is restricted by the step G1, so that misalignment of the drain pipe D or the like can be suppressed. Therefore, while suppressing the external dimension of the whole toilet main body 4, the region more rearward than the bowl 8 of the toilet main body 4 is divided in the up-down direction by the supporting wall 48 to form the upper region V1 and the lower region V2, and the upper region V1 can be effectively used as a part above the opening 44 and discharge socket storage 46.

Furthermore, according to the flush toilet 1 of the present embodiment, as shown in FIG. 9, the peripheral wall that forms the side wall surface 44*a* on the rear side of the opening 44 is formed by the double wall E including the outer wall 42*c* and the inner wall 42*d* that form the rear wall 42*a* of the skirt 42, so that strength of the opening 44 can increase. Consequently, the number of members including a reinforcing member for reinforcing the opening 44 can be decreased, so that a peripheral region of the opening 44 can be effectively used as a part of the storage region that stores the control unit (flush water supply device 6).

Also, according to the flush toilet 1 of the present embodiment, since the top surface 44*b* in the opening 44 and the top surface 46*b* in the discharge socket storage 46 are at about the same height position as each other and formed to be flush with each other, the number of members including a reinforcing member for acquiring strength of the opening 44 or the discharge socket storage 46 can be decreased. Therefore, the peripheral region around the opening 44 and the discharge socket storage 46 can be effectively used as a part of the storage region that stores the control unit (flush water supply device 6).

Furthermore, according to the flush toilet 1 of the present embodiment, through the first communication holes 50 and 52 in the bottom surface of the auxiliary wall 48*c* of the supporting wall 48 to communicate between the upper region V1 of the rear storage V0 in the region more rearward than the bowl 8 of the toilet main body 4 and the internal space I of the double wall E of the skirt 42, and through the second communication holes 56 and 58 in the outer walls 42*c* in the side wall 42*b* and the rear wall 42*a* of the skirt 42 to communicate between the internal space I of the double wall E of the skirt 42 excluding the lower region V2 of the rear storage V0 and the outside of the toilet main body 4, the upper region V1 of the rear storage V0 can communicate with the outside of the toilet main body 4 through the internal space I of the double wall E of the side wall 42*b* or the rear wall 42*a* of the skirt 42, without through the lower region V2 of the rear storage V0 (the interior of the discharge socket storage 46). Therefore, in the control unit (flush water supply device 6) stored in the upper region V1 of the rear storage V0, even if water cover or out-of-machine water leakage occurs, the water cover or water leakage w1 in the upper region V1 of the rear storage V0 can be discharged to the outside of the toilet main body 4 from the first communication holes 50 and 52 in the bottom surface of the auxiliary wall 48*c*, without through the lower region V2 of the rear storage V0 (the interior of the discharge socket storage 46), and from the second communication holes 56 and 58 through the internal space I of the double wall E of the skirt 42. Consequently, the water leakage w1 from the control unit (flush water supply device 6) can be easily confirmed outside of the toilet main body 4. Also, water leakage or power leakage from the control unit (flush water supply device 6) can be prevented from being transmitted to the discharge socket S or the like in the discharge socket storage 46 in the lower region V2 of the rear storage V0, so that fire resistance in the lower region V2 of the rear storage V0 can be inhibited from being affected.

Further, according to the flush toilet 1 of the present embodiment, in the control unit (flush water supply device 6) stored in the upper region V1 of the rear storage V0, even if water cover or out-of-machine water leakage occurs, the water cover or water leakage w1 in the upper region V1 of the rear storage V0 can be discharged from the first communication holes 50 and 52 in the bottom surface of the auxiliary wall 48*c* and through the internal space I of the double wall E of the skirt 42 that forms the opening 44, without through the lower region V2 of the rear storage V0 (the interior of the discharge socket storage 46). Afterward, the water cover or water leakage w1 in the internal space I of the double wall E in the rear wall 42*a* and the side wall 42*b* of the skirt 42 can be discharged from the second communication holes 56 and 58 to the floor F outside of the toilet main body 4. Therefore, the water cover or water leakage w1 in the control unit (flush water supply device 6) can be easily confirmed with the water leakage w1 in the floor F outside of the toilet main body 4. Furthermore, the concave portion 42*f* of the bottom portion 42*e* of the double wall E in the rear wall 42*a* of the skirt 42 that forms the opening 44 separates the lower region V2 of the rear storage V0 from the outside of the toilet main body 4. Therefore, water leakage or power leakage from the control unit (flush water supply device 6) can be prevented from being transmitted to the discharge socket S or the like in the discharge socket storage 46 in the lower region V2 of the rear storage V0. Therefore, water cover or out-of-machine water leakage in the control unit (flush water supply device 6) can be inhibited from affecting fire resistance in the lower region V2 of the rear storage V0 and for the discharge socket S.

Although the present disclosure has been explained with reference to specific, preferred embodiments, one of ordinary skill in the art will recognize that modifications and improvements can be made while remaining within the scope and spirit of the present disclosure. The scope of the present disclosure is determined solely by appended claims.

What is claimed is:

1. A flush toilet comprising:

a toilet main body made of ceramics, the toilet main body including a bowl configured to receive waste and a water discharge trap configured to discharge the waste in the bowl, the water discharge trap including an inlet connected to a lower portion of the bowl, a control unit provided more rearward than the bowl of the toilet main body, the control unit being configured to control discharge and stopping of flush water to the bowl, and a discharge socket configured to connect a drain pipe provided behind or below the toilet main body and an outlet of the water discharge trap, wherein the toilet main body further includes a skirt and a rear storage configured to store at least a part of the control unit, the skirt being formed on an outer side of side surfaces of the bowl and the water discharge trap, and the rear storage being provided below an upper end of the skirt and on an inner side than the skirt in a region more rearward than the bowl, the skirt includes a rear wall provided on a back surface of the toilet main body, and the rear wall includes an opening to which the drain pipe is connected, the opening being formed penetrating in a front-rear direction and below a center in a left-right direction of the rear wall of the skirt, the rear storage includes a discharge socket storage configured to store the discharge socket, the discharge socket storage being formed on a front side of the opening in a region below a center of the rear storage in the left-right direction, and a first side wall surface forming a side wall surface in the discharge socket storage protrudes more in a center direction of the opening than a second side wall surface forming a side wall surface in the opening in order to reduce an opening cross-sectional area of the discharge socket storage to be smaller than an opening cross-sectional area of the opening.

2. The flush toilet according to claim 1, wherein the rear storage includes a supporting wall configured to support the control unit, the supporting wall divides the region more rearward than the bowl of the toilet main body in an up-down direction to form an upper region and a lower region, the upper region includes a storage region configured to store at least a part of the control unit, and the lower region includes an open region of each of the opening and the discharge socket storage, the supporting wall includes the first side wall surface, the second side wall surface, and a joining portion configured to join the first side wall surface and the second side wall surface to each other, and the joining portion is provided with a step configured to protrude the first side wall surface more in the center direction of the opening than the second side wall surface to reduce the opening cross-sectional area of the discharge socket storage to be smaller than the opening cross-sectional area of the opening.

3. The flush toilet according to claim 2, wherein the skirt further includes a side wall forming a side surface of the skirt, at least a part of the side wall or the rear wall of the skirt forms a double wall including an outer wall and an inner wall, the outer wall forms an outer surface of the skirt, and the inner wall is provided inside the outer wall, at least a part of the double wall forms an internal space between the outer wall and the inner wall, and at least a part of the opening is formed by the double wall.

4. The flush toilet according to claim 1, wherein the opening and the discharge socket storage have top surfaces that are formed to be substantially flush with each other.

5. The flush toilet according to claim 3, wherein the supporting wall includes a main wall and an auxiliary wall provided outside the main wall, and the main wall divides the region more rearward than the bowl into the upper region and the lower region, and the auxiliary wall includes the inner wall of the skirt dividing the upper region from the internal space of the double wall of the skirt, the auxiliary wall further includes a first communication hole formed on a bottom surface, and the first communication hole communicates between the upper region and the internal space of the double wall of the skirt, and the auxiliary wall further includes a second communication hole formed on the outer wall forming the internal space of the double wall in the side wall or the rear wall of the skirt, and the second communication hole communicates between the internal space of the double wall of the skirt excluding the lower region and outside of the toilet main body.

6. The flush toilet according to claim 5, wherein the double wall in the rear wall of the skirt forming the opening includes a bottom portion contactable with a floor in a state where the toilet main body is installed, the bottom portion includes a concave portion being upwardly concave to separate the lower region from the outside of the toilet main body, and the second communication hole is formed penetrating the concave portion to communicate between the internal space of the double wall of the skirt excluding the lower region and the outside of the toilet main body.

* * * * *